US009693614B1

(12) United States Patent
Brian

(10) Patent No.: US 9,693,614 B1
(45) Date of Patent: Jul. 4, 2017

(54) MAGNETICALLY ATTACHABLE ORGANIZATIONAL AID FOR ELECTRONIC DEVICES

(71) Applicant: Michael W. Brian, Lubbock, TX (US)

(72) Inventor: Michael W. Brian, Lubbock, TX (US)

( * ) Notice: Subject to any disclaimer, the term of this patent is extended or adjusted under 35 U.S.C. 154(b) by 0 days.

(21) Appl. No.: 15/137,798

(22) Filed: Apr. 25, 2016

(51) Int. Cl.

| | |
|---|---|
| ***B65D 33/14*** | (2006.01) |
| ***A45C 13/10*** | (2006.01) |
| ***A45C 11/00*** | (2006.01) |
| ***A45C 13/00*** | (2006.01) |

(52) U.S. Cl.
CPC ..... *A45C 13/1069* (2013.01); *A45C 11/00* (2013.01); *A45C 13/001* (2013.01); *A45C 2011/003* (2013.01)

(58) Field of Classification Search
CPC ... A45C 13/1069; A45C 11/00; A45C 13/001; A45C 2011/003
USPC ..... 383/11, 22, 39
See application file for complete search history.

(56) References Cited

U.S. PATENT DOCUMENTS 3,717,188 A * 2/1973 Green ..... G11B 23/0236 206/387.15
4,736,853 A * 4/1988 O'Mara ..... A45C 11/00 206/224
5,598,923 A * 2/1997 Owens ..... A61B 50/312 150/130
6,149,001 A * 11/2000 Akins ..... A45C 13/26 150/165
6,336,555 B1 * 1/2002 Breeden ..... A45C 11/24 206/214
7,921,997 B2 * 4/2011 Burns ..... A45C 13/00 206/320
8,418,852 B2 * 4/2013 Ziemba ..... A45C 1/04 206/235
8,978,886 B2 * 3/2015 Ziemba ..... A45C 1/04 206/320
2007/0147712 A1 * 6/2007 Ozdeger Donovan ... B42F 7/06 383/22
2015/0351271 A1 * 12/2015 Dawson ..... B65D 51/28 220/521

* cited by examiner

*Primary Examiner* — Jes F Pascua
(74) *Attorney, Agent, or Firm* — Ross Barnes LLP; Monty L. Ross; Robin L. Barnes

(57) ABSTRACT

An organizational aid suitable for use with a personal electronic device having a plurality of discrete pockets, at least one flexible security tab to secure the organizational aid in position on an outwardly facing surface of the device, at least two spaced-apart, non-slip surface portions attached to a back surface of the organizational aid, and at least one magnet or magnetic strip disposed adjacent to the non-slip surface to releasably hold the organizational aid in a desired juxtaposition to an outwardly facing surface of the electronic device. If desired, at least one magnet can be attached to or embedded inside each of the non-slip surface portions, and the magnets and non-slip surfaces will cooperate with the security tab or tabs to hold the organizational aid in place during transport of the electronic device.

8 Claims, 3 Drawing Sheets

MAGNETICALLY ATTACHABLE ORGANIZATIONAL AID FOR ELECTRONIC DEVICES

BACKGROUND OF THE INVENTION

1. Field of the Invention

This invention relates to organizational aids that are selectively attachable to and removable from electronic devices such as tablets and laptops. The subject device desirably comprises a plurality of storage pockets and is particularly useful with electronic devices having surfaces to which magnets are attachable. Use with electronic devices such as an iPad® and associated cover or a Microsoft Surface™ personal computing device configured for use in conjunction with an external keyboard or mouse is preferred.

2. Description of Related Art

Users of modern personal electronic devices, and particularly slim-line tablets usable with a detachable covers or keyboard or mouse, frequently encounter a need for compact, readily accessible storage for pens, pencils, flash drives, a wireless mouse, or the like, without having to carry a separate bag or pouch to transport such articles.

SUMMARY OF THE INVENTION

The organizational aid disclosed here is suitable for use with a personal electronic computing device such as an iPad® with a detachable cover or a Microsoft Surface™ device having a screen side and a keyboard side that are preferably but not necessarily detachable from each other. Such devices will preferably have an outwardly facing surface to which magnetic elements such as magnetic strips or magnets are attachable. The subject organizational aid desirably comprises a plurality of discrete pockets or divided areas, at least some of which are provided with closures. At least one, and preferably two, spaced-apart flexible security tabs are desirably positionable between the screen and keyboard sides of the personal electronic computing device to secure the organizational aid in position on the outwardly facing surface of the device when the screen and keyboard sides are folded back together following use. At least one and preferably two or more non-slip surface portions are desirably attached to a back surface of the organizational aid and are configured to provide facing and contacting engagement with an outwardly facing surface of the computing device; and at least one magnetic element attached to, disposed adjacent to or embedded in the non-slip surface portion to releasably hold the organizational aid in a desired position relative to the outwardly facing surface of the electronic device. If desired, at least one magnetic element can be attached to or embedded inside each of the non-slip surface portions, and the magnets and non-slip surfaces will cooperate with the security tab or tabs to hold the organizational aid in place during transport of the electronic device.

BRIEF DESCRIPTION OF THE DRAWINGS

The system and method of the invention are further described and explained in relation to the following drawings wherein.

Figure 1:
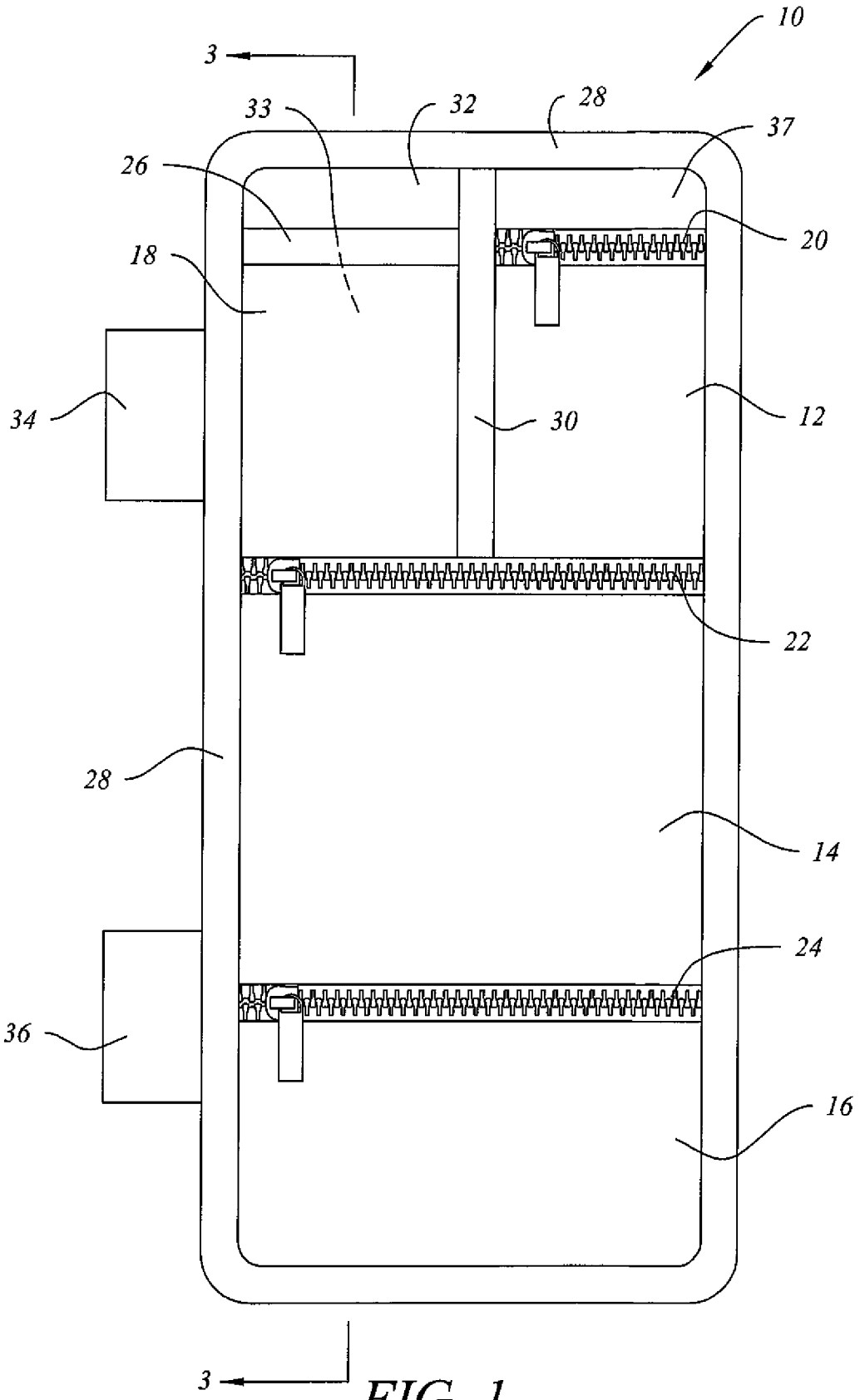
FIG. 1 is a top plan view of one embodiment of an organizational aid of the invention.

It is noted that the drawings are illustrative and diagrammatic in nature, are not drawn to scale, and that the ratio and proportion of various parts of the invention can vary from those depicted in the drawings. It is also emphasized that the drawings represent only one of many different configurations of the invention that can be made within the scope of the appended claims.

DESCRIPTION OF THE PREFERRED EMBODIMENTS

Referring to FIG. 1, organizational aid 10 further comprises a plurality of individual pockets 12, 14, 16, 18 that are desirably formed by overlaying appropriately sized swatches of a suitable, preferably water resistant, fabric over a substantially continuous backing sheet 32 (best seen in FIG. 2) and then stitching, gluing or otherwise attaching a binding material around the edges of each swatch. In the embodiment shown, zippers 20, 22, 24 are used to close pockets 12, 14, 16, respectively, and binding strip 28 is wrapped over the peripheral edges of organizational aid 10 to provide containment between the pockets and backing sheet 32. Flexible security tabs 34, 36 desirably project outwardly from one side of organizational aid 10 for insertion between the screen side and keyboard side of a personal electronic device as previously described in the Summary of the Invention. Security tabs 34, 36 are desirably made of a flexible, durable fabric and can be secured by stitching, gluing or another similarly effective fastening technique, to binding strip 28, back cover 32 (FIG. 2), or both. In the embodiment shown in FIG. 1, pocket 18 has an open edge covered by binding strip 26 that permits objects, possibly a wireless mouse, to be inserted into void 33 disposed between pocket 18 and the backing sheet behind the pocket.

Figure 2:
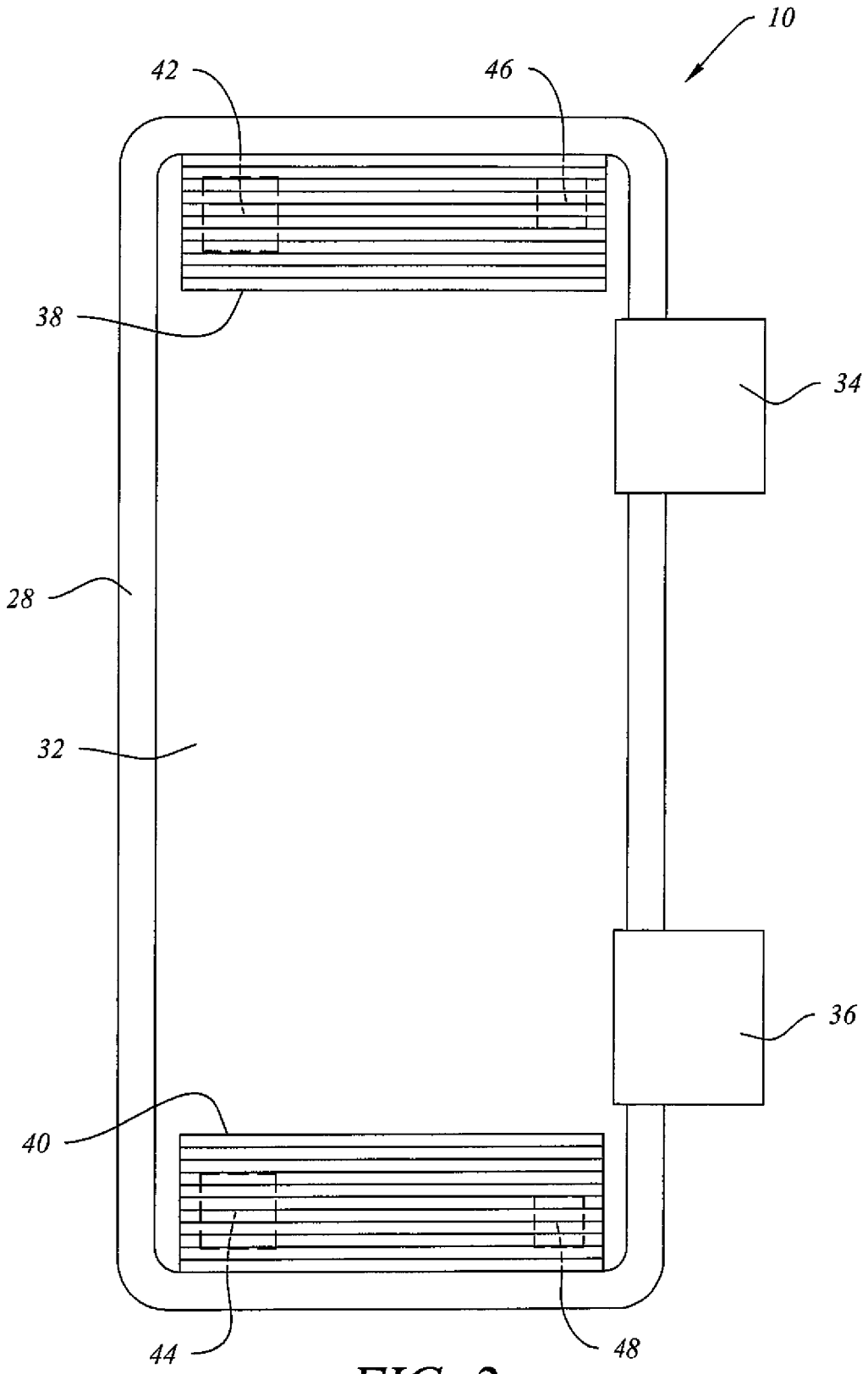
FIG. 2 is a bottom plan view the embodiment of FIG. 1.

Referring to FIG. 2, a plurality of rubbery, ribbed non-slip strips 38, 40 are attached to backing sheet 32 by stitching, gluing, or another similarly effective fastening technique suitable for such application. Rare-earth magnets 42, 44, 46, 48, preferably made of neodymium, are preferred for use in the invention. The magnets and non-slip strips are believed to cooperate in preventing organizational aid 10 from sliding about on the outwardly facing surface of the electronic device with which they are placed in contact during use or transport of the electronic device. Security tabs 34, 36, similarly attached to backing sheet 32 or binding strip 28, are sufficiently flexible that the portion insertable between the aligned edges of the screen and keyboard or cover portions of the electronic device can be folded in a U-shape as the screen and keyboard or cover portions are rotated into facing engagement with each other.

Figure 3:
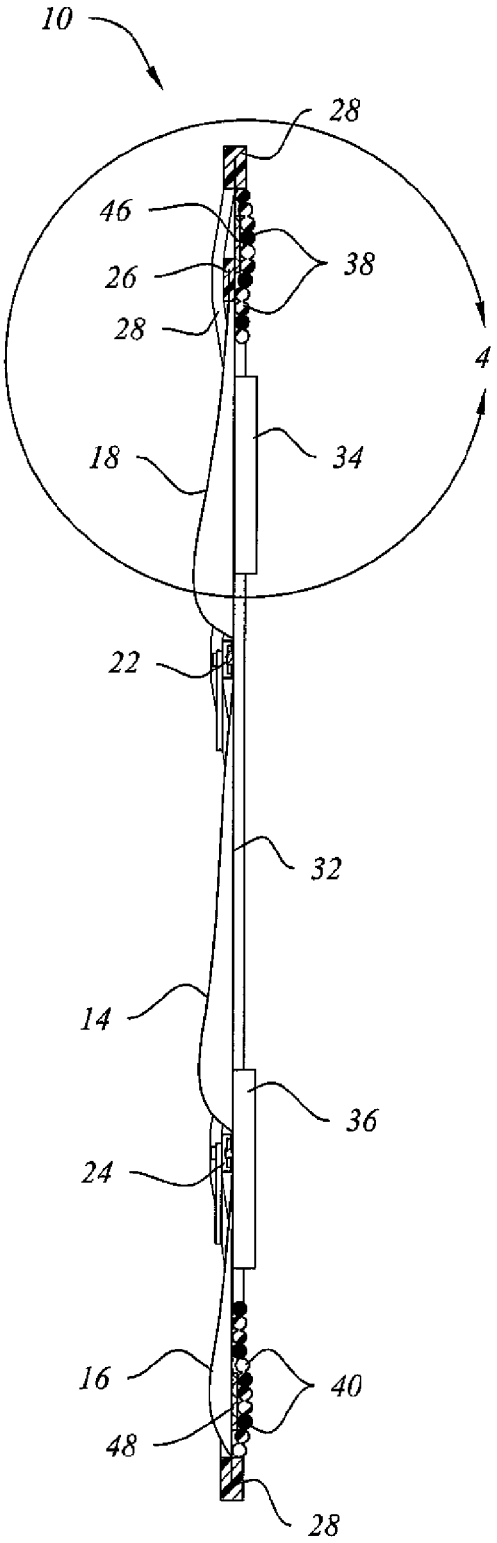
FIG. 3 is a cross-sectional side elevation view taken along line 3-3 of FIG. 1.
Figure 4:
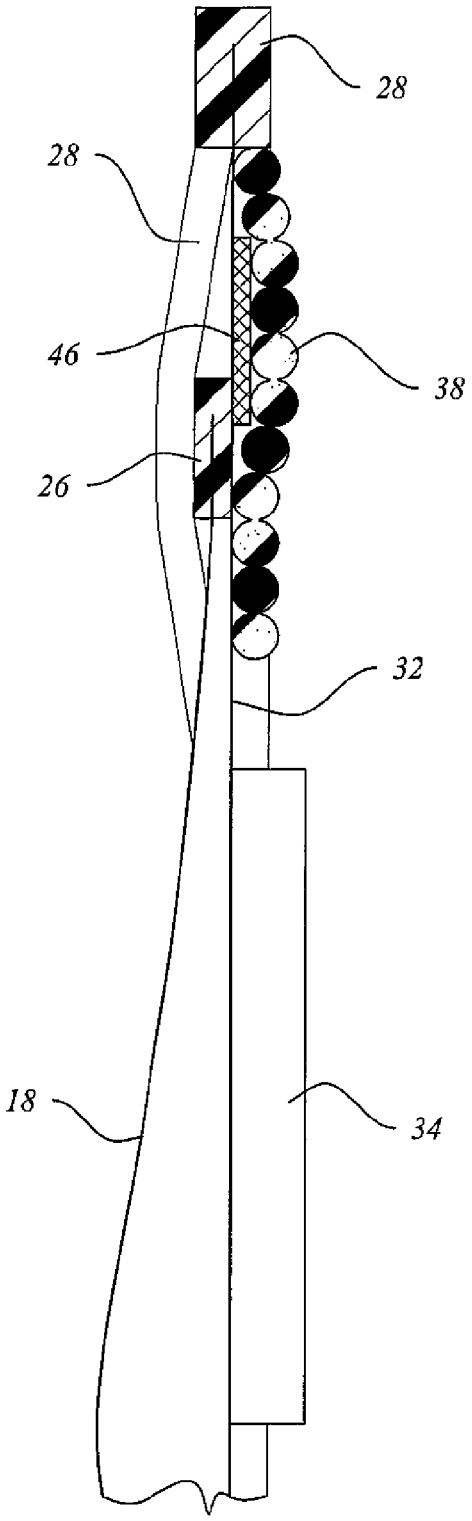
FIG. 4 is an enlarged detail view taken from FIG. 3.

Referring to FIGS. 3 and 4, it will be appreciated that backing sheet 32 can be the back wall of each of pockets 18, 14, 16 or, alternatively, each pocket can have its own back wall in addition to the backing sheet 32 if desired. The fabric used for making the backing sheet and the various pockets of organizational aid 10 can be made of the same or different flexible materials, and the use of various coated and uncoated, woven or unwoven fabrics, transparent polymeric sheeting, braided mesh, and the like are all contemplated for possible use within the scope of the invention. Similarly, other types of pocket closures, including for example and without limitation hook and loop fasteners, snaps, buttons, sliding Ziploc® seals and the like, can be used in place of one or more of the zippers shown in the accompanying drawings.

Where use of organizational aid 10 is desired with electronic devices having outwardly facing surfaces that lack magnetically attachable areas, stick-on magnets of suitable polarity can be provided and attached in fixed relation to the electronic device so as to provide an attachment surface for the magnets embedded in or attached to organizational aid 10, thereby permitting its use, for example, with electronic devices having polymeric, aluminum, or other non-ferrous metal outer skins.

Those of ordinary skill in the art will appreciate upon reading this specification and the description of embodiments in relation to the drawings that other modifications and alterations to the apparatus and methods may be made within the scope of the invention. In such case it is intended that the scope of the invention disclosed herein be limited only by the broadest reasonable interpretation of the appended claims to which the inventor is legally entitled.

I claim:

1. An organizational aid suitable for use with a personal electronic device, the organization aid comprising:

a substantially continuous backing sheet;

a plurality of discrete pockets disposed over the backing sheet;

at least one flexible security tab to secure the organizational aid in position on an outwardly facing surface of the personal electronic computing device;

a rearwardly facing, non-slip surface portion; and at least one magnetic element attached to the organizational aid and positioned to hold the organizational aid in a desired position relative to an outwardly facing surface of the electronic device.

2. The organizational aid of claim 1 comprising at least two spaced-apart flexible security tabs.

3. The organizational aid of claim 1 comprising at least two rearwardly facing, spaced-apart non-slip surface portions.

4. The organizational aid of claim 1 comprising at least two spaced-apart magnetic elements positioned to hold the organizational aid in a desired position relative to an outwardly facing surface of the electronic device.

5. The organizational aid of claim 1 wherein at least one of the plurality of discrete pockets comprises a closure member.

6. The organizational aid of claim 1 wherein the at least one magnetic element is attached to or embedded inside the rearwardly facing, non-slip surface portions.

7. The organization aid of claim 1 wherein the at least one magnetic element and the non-slip surface portion cooperate with the at least one flexible security tab to hold the organizational aid in desired juxtaposition to the electronic device.

8. The organizational aid of claim 2 wherein the security tabs are insertable between two facing and contacting portions of the personal electronic device.

* * * * *